United States Patent [19]

Bricker

[11] Patent Number: 4,735,152

[45] Date of Patent: Apr. 5, 1988

[54] CANTILEVER SHELF

[75] Inventor: Melvin E. Bricker, Cincinnati, Ohio

[73] Assignee: Bricker Products, Inc., Cincinnati, Ohio

[21] Appl. No.: 67,267

[22] Filed: Jun. 25, 1987

[51] Int. Cl.[4] ..... A47N 57/00

[52] U.S. Cl. ..... 108/97; 108/152; 248/218.4; 248/219.1; 248/230

[58] Field of Search ..... 248/316.1, 245, 230, 248/225.31, 218.4, 219.1; 108/134, 151, 152, 144; 297/437; 312/235

[56] References Cited

U.S. PATENT DOCUMENTS

| | | | |
|---|---|---|---|
| 239,909 | 4/1881 | Woodward | 108/152 |
| 888,366 | 5/1908 | Sutton . | |
| 939,764 | 11/1909 | Vickers et al. . | |
| 1,219,832 | 3/1917 | Mathias | 248/245 |
| 1,288,197 | 12/1918 | Rice | 248/245 X |
| 2,512,958 | 6/1950 | Meier . | |
| 2,713,530 | 7/1955 | Chisholm . | |
| 2,984,443 | 5/1961 | Bergengren | 108/152 |
| 3,134,474 | 5/1964 | Marchman | 248/245 X |
| 3,186,764 | 6/1965 | Lockshin | 248/230 X |
| 3,223,054 | 12/1965 | Novak . | |
| 3,672,312 | 6/1972 | Pettit et al. . | |
| 3,797,790 | 3/1974 | Iseki | 248/230 |
| 3,868,081 | 2/1975 | Morgan | 248/245 |
| 4,311,101 | 1/1982 | de Almagro . | |

FOREIGN PATENT DOCUMENTS

| | | | |
|---|---|---|---|
| 413332 | 3/1910 | France | 248/245 |
| 58395 | 8/1969 | German Democratic Rep. | 248/230 |

*Primary Examiner*—Peter A. Aschenbrenner
*Attorney, Agent, or Firm*—Wood, Herron & Evans

[57] ABSTRACT

A cantilever shelf assembly adapted to mount to the opposed legs at one end or side of a table, chair and the like comprises a pair of shelf support brackets each having a U-shaped end forming opposed clamp arms adapted to rest against the leg. A set screw is inserted through the upper portion of each clamp arm into contact with one side of the leg so that when the shelf support brackets are loaded the lower end of the clamp arms tends to pivot about the set screws to wedge the leg therebetween. A bolt extending between the clamp arms of each shelf support bracket maintains the relative lateral spacing therebetween to avoid fracture of the clamp arms. A stabilizer is also provided comprising a rod positioned between the legs and below the cantilever shelf which is mounted to each leg by a strap to prevent lengthwise collapse of the table or chair when the cantilever shelf is heavily loaded.

7 Claims, 2 Drawing Sheets

CANTILEVER SHELF

FIELD OF THE INVENTION

This invention relates to shelves, and, more particularly, to a cantilever shelf adapted to mount at one end to the legs of a table or chair to provide additional surface area for the support of machinery, supplies or the like.

BACKGROUND OF THE INVENTION

Cantilever shelf attachments adapted to mount to the legs at one end of chairs or tables are disclosed, for example, in U.S. Pat. Nos. 888,366 to Sutton; 939,764 to Vickers et al, and 4,311,101 to de Almagro. Shelf attachments of this type include a pair of support arms adapted to mount to the spaced legs at one end of a chair or table, and a planar shelf secured atop the support arms. Such cantilever shelves add to the useful surface area of the table and can be mounted at a height lower than the table top to facilitate the operation of food processors, cheese slicers or any other type of equipment.

Although useful in some applications, the cantilever shelf attachments of the type described above also have limitations and problems. The structure disclosed in the U.S. Pat. No. 888,366 to Sutton, for example, is designed to fit a special style leg of a stool or chair and is not adapted for use on tables and chairs having legs of different sizes or configuration. Other shelf attachments, such as disclosed in the Vickers et al U.S. Pat. No. 939,764, employ one or more support arms formed in two opposed sections each of which has at least one arcuate end adapted to fit around a portion of the leg. The two sections of the support arm are connected together and to the leg by a bolt extending therebetween which is tightened to draw the sections together against the leg. This type of structure is relatively expensive to manufacture, cumbersome to install and can result in failure of the opposed sections of the support arms if they are connected together too tightly.

Additionally, no provision is made in the shelf attachments of the type disclosed in the patents to Sutton, Vickers et al and de Almagro to guard against lengthwise collapse of a table having no support member connected between its legs. A heavy load placed on a cantilever shelf mounted to the legs at one end of such a table can collapse all four legs in a direction toward such end wherein the table top and the top of each leg shift laterally toward the weight.

SUMMARY OF THE INVENTION

It is therefore among the objectives of this invention to provide a cantilever shelf assembly which is easy to assemble and disassemble on the legs of a table or chair, which is adjustable vertically and laterally relative to the table or chair legs and which is capable of supporting a substantial amount of weight without failure or damage to the table or chair.

These objectives are accomplished in a shelf assembly which comprises a pair of support brackets adapted to be adjustably mounted along the length of the spaced legs of the table or chair, a shelf horizontally mounted to the support brackets and laterally adjustable relative thereto, and a stabilizer leg mounted at the end of the table or chair legs supporting the cantilever shelf which prevents collapse of the table.

In the presently preferred embodiment, each support bracket is formed with a horizontal top surface having a pair of spaced, laterally extending ears and a lower surface which tapers with respect to the upper surface so that the spacing or height dimension between the upper and lower surfaces increases from one end of the support brackets to the other. The end of the support brackets having the largest height dimension in U-shaped forming a pair of elongated, spaced clamp arms which define a continuous arcuate inner surface therebetween adapted to rest against the cylindrical leg of a table or chair. Preferably, the spaced clamp arms of both support brackets extend generally parallel to one another and each are formed with an inner, threaded bore and an outer throughbore at the upper end thereof.

The shelf is mounted atop the horizontal top surface of each support bracket by screws or bolts which extend into slots formed in the laterally extending ears of the support brackets. The lateral position of the shelf relative to the support brackets is adjustable to accommodate variations in spacing between the legs of different sized tables or chairs. This is accomplished by sliding the bolts along the elongated slots formed in the ears of the support brackets and then fastening a nut on the end of the bolt when the shelf is in the desired position.

The support brackets and shelf are mounted to the legs of the table or chair by resting the U-shaped ends of the support brackets against the legs so that the spaced clamp arms straddle the legs and the inner arcuate surface formed therebetween rests against outer side of the legs. In this position, the threaded bores at the upper end of the clamp arms of each support bracket align with the inner side of the table leg opposite the outer side where the arcuate surface of each clamp arm is positioned. Set screws are then inserted through the threaded bores into contact with the inner side of the leg to retain the brackets in position therealong.

The height of the U-shaped end of the support brackets is such that the lower end of the arcuate surface of each clamp arm thereof contacts the table or chair leg at a location substantially beneath each of the set screws. A downward load applied to the shelf tends to pivot the lower end of each clamp arm with respect to the set screws to force the lower end against the outer side of the leg. This wedges the leg between the set screws on the inner side of the leg and lower end of the support arms on the outer side of the leg to maintain the support brackets and shelf in position thereon. The magnitude of force applied to the lower end of each clamp arm is proportional to the load or weight of the object placed on the shelf.

A lag bolt is then inserted through the aligning, outer throughbores of the spaced clamp arms of each support bracket which is secured therebetween by a nut. The lag bolt maintains the relative spacing between the clamp arms of each support bracket to prevent them from moving too far toward or away from one another which could fracture the support bracket.

In a presently preferred embodiment, a stabilizer leg is mounted at the base of the table or chair legs beneath the cantilever shelf assembly to prevent the collapse of the table, i.e., in a lengthwise direction toward the cantilever shelf assembly, particularly when mounting heavy loads upon the shelf. The stabilizer leg comprises a vertical rod spaced outwardly from and at the center of the table or chair legs, which is attached thereto by a strap extending around the rod and mounted at each end to one leg of the table.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
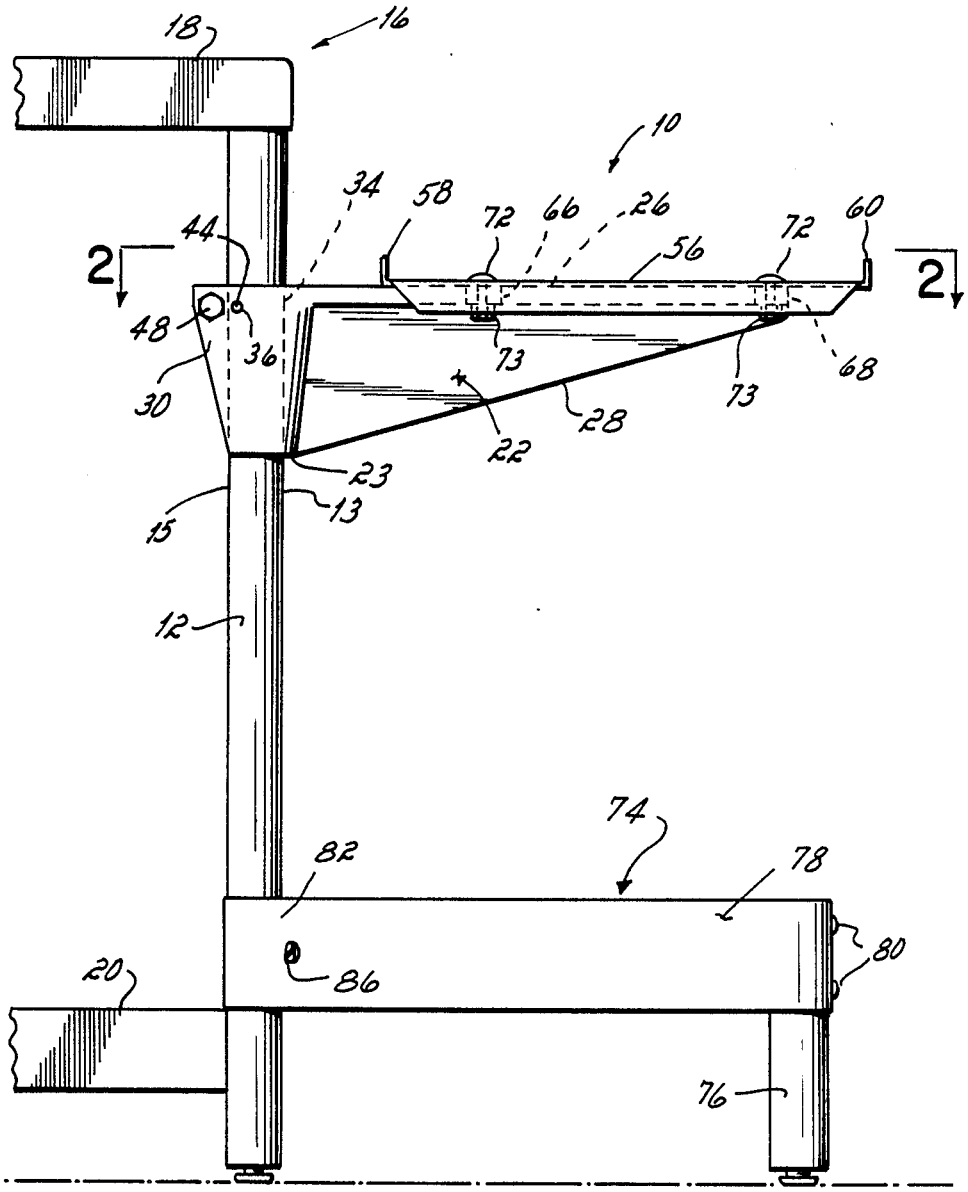
FIG. 1 is a side elevational view of the cantilever shelf assembly and stabilizer leg of this invention.

Referring now to the Figs., the shelf assembly 10 is shown mounted to the legs 12, 14 of a table 16. For purposes of the present discussion, the direction "upward" or top portion of the structure herein shall refer to the direction toward the table top 18, and the term "downward" or bottom portion refers to the direction toward the base 20 of the table 16. It should be understood that while a table 16 is illustrated in the Figs., the shelf assembly 10 of this invention can be adapted for mounting to a chair, stool or the like.

The shelf assembly 10 comprises a pair of support brackets 22, 24 each having a planar, horizontally disposed upper surface 26 and a tapered or angled lower surface 28. The spacing or height dimension between the upper and lower surfaces 26, 28 increases from the outer end of the support brackets 22, 24 to the inner end where a pair of elongated, spaced clamp arms 30, 32 are formed on each support bracket 22, 24. The clamp arms 30, 32 of support brackets 22, 24 are formed in a U-shape which defines a continuous arcuate inner surface 34 adapted to rest against the outer side 13 of cylindrical table legs 12, 14, respectively.

The clamp arm 30 of each support bracket 22, 24 is formed with an inner threaded bore 36 and an outer throughbore 38. Both the threaded bore 36 and throughbore 38 are formed near the top of the clamp arm 30 just below the planar upper surface 26 of support brackets 22, 24. The clamp arm 32 of support brackets 22, 24 is formed with a threaded bore 40 which aligns with the threaded bore 36 of clamp arm 30, and a throughbore 42 which aligns with the throughbore 38 of clamp arm 30. With the support brackets 22, 24 in position against the legs 12, 14, the threaded bores 36, 40 of each support bracket 22, 24 align with a point on the inner side 15 of legs 12, 14, opposite the outer side 13, and the throughbores 38, 42 are spaced rearwardly of the table legs 12, 14.

The support brackets 22, 24 are mounted to the table legs 12, 14 by first inserting set screws 44, 46 through the threaded bores 36, 40, respectively, and tightening them into engagement with the table legs 12, 14. A bolt 48 is then inserted through the throughbores 38, 42 of the clamp arms 30, 32 of each support bracket 22, 24, and is secured in place by a nut 52.

The set screws 44, 46 serve a dual purpose. First, set screws 44, 46 mount the support brackets 22, 24 in the desired vertical position along the length of table legs 12, 14. Additionally, set screws 44, 46 form a pivot point about which the clamp arms 30, 32 of support brackets 22, 24 can rotate when they are placed under load. In response to a downward vertical force at the outer ends of the support brackets 22, 24, the clamp arms 30, 32 at the opposite end of support brackets 22, 24 tend to pivot in a clockwise direction as illustrated in FIG. 1 such that the lower end 23 of each support bracket 22, 24 is forced against the table legs 12, 14. Such pivotal motion occurs because the set screws 44, 46 are located near the upper surface 26 of support brackets 22, 24 on the inner side 15 of the table legs 12, 14 rearwardly of the center or longitudinal axis thereof, whereas the lower end 23 of each clamp arm 30, 32 engages the outer side 13 of legs 12, 14 at a location spaced substantially below the set screws 44, 46.

In effect, the table legs 12, 14 become wedged between the set screws 44, 46 on the inner side 15 of leg 12, and the lower end 23 of each support bracket 22, 24 on the outer side 13 of leg 12. The set screws 44, 46 are prevented from moving laterally outwardly toward the outer side 13 of legs 12, 14 in response to the inward pivoting motion of the lower end 23 of each support bracket 22, 24 because they are located on the inner side 15 of the legs 12, 14, rearwardly of the center thereof, and are thus blocked from such outward movement by the center portion of the table legs 12, 14. The larger the downwardly directed load applied to the support brackets 22, 24, the greater the force urging the lower edge 23 of clamp arms 30, 32 against the outer side 13 of table legs 12, 14, and the greater the force urging the set screws 44, 46 against the inner side 15 thereof.

The bolts 48 are primarily intended to maintain the clamp arms 30, 32 in a fixed lateral position with respect to one another. This prevents the clamp arms 30, 32 from being drawn too far together or spreading too far apart which could create a fracture at some point along the arcuate inner surface 34 therebetween.

Once the support brackets 22, 24 are secured in position upon the legs 12, 14, a shelf 56 is mounted upon the planar upper surfaces 26 of each support bracket 22, 24. The shelf 56 is formed with upturned inner and outer edges 58, 60, respectively, and four bores (not shown) at the corners thereof. In the presently preferred embodiment, the upper surface 26 of each support bracket 22, 24 is formed with a pair of laterally extending ears 66, 68 each having an elongated slot 70. A bolt 72 is inserted through the bores of the shelf 56 and into a slot 70 in the ears 66, 68 of each support bracket 22, 24 to mount the shelf 56 upon the support brackets 22, 24. The bolts 72 are slidable within the slots 70 to adjust the lateral position of the shelf 56 with respect to the support brackets 22, 24, and are then secured by a nut 73.

Figure 2:
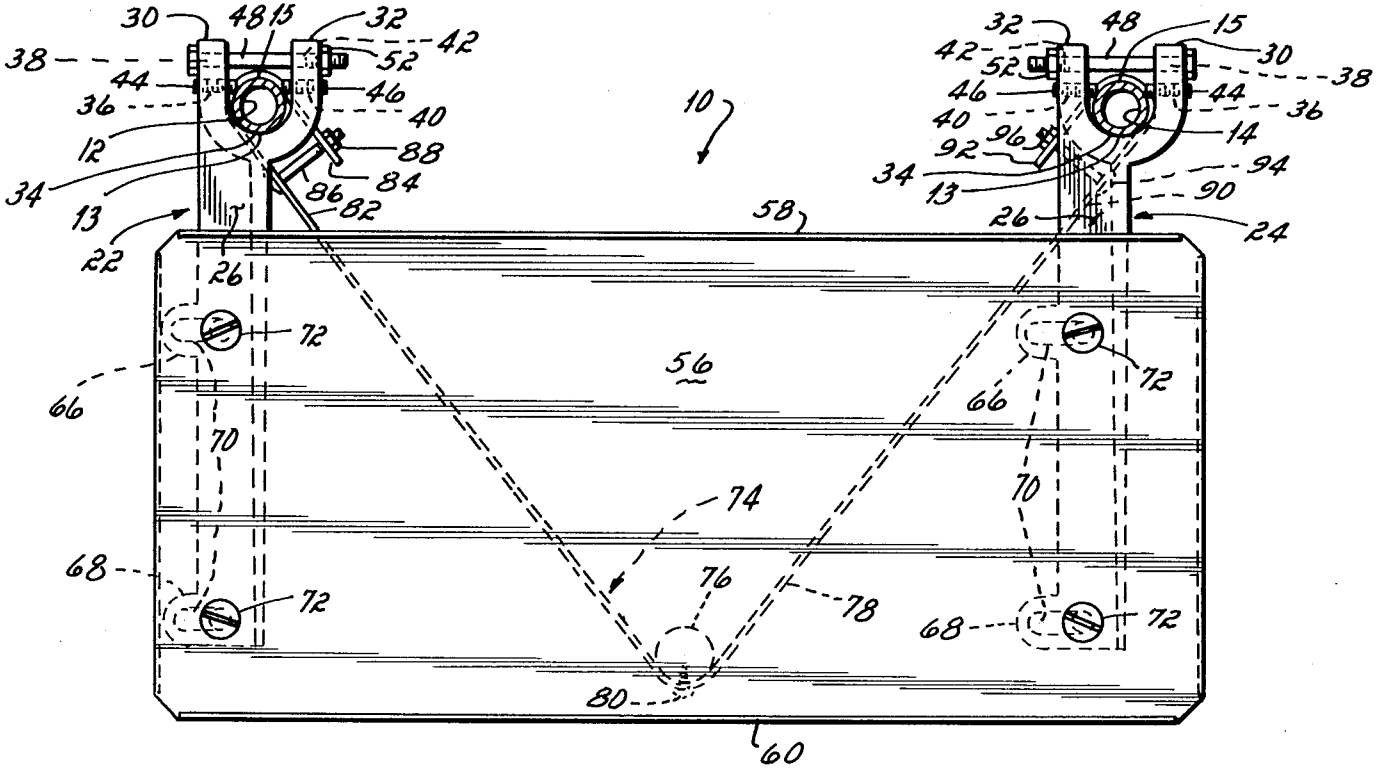
FIG. 2 is a plan view of the cantilever shelf assembly as seen along line 2—2 of FIG. 1 showing the table legs in cross section and the stabilizer leg in phantom.

Some tables are not provided with supports or braces extending lengthwise between their legs and it is possible for the table to collapse, i.e., in a lengthwise direction toward the shelf assembly 10, if the shelf assembly 10 is heavily loaded. In order to avoid such a problem, a stabilizer assembly 74 is provided for use with the shelf assembly 10. The stabilizer assembly 74 includes a leg 76 which is positioned approximately midway between the table legs 12, 14 directly beneath the outer end of the shelf assembly 10. A continuous strap 78 is wrapped about the leg 76 and affixed thereto by rivets, screws or other essentially permanent fasteners 80. As shown in FIG. 2, one side 82 of the strap 78 extends to the leg 12 and wraps therearound forming a U-shaped end 84 which is clamped against the leg 12 by a bolt 86 and nut 88. Similarly, the opposite side 90 of the strap 78 extends to the leg 14 forming a U-shaped end 92 which wraps around the leg 14 and is clamped thereto by a bolt 94 and nut 96. The stabilizer assembly 74 is optional but is preferably employed in applications where a heavy machine or other such load is applied to the shelf assembly 10.

While the invention has been described with reference to a preferred embodiment, it will be understood by those skilled in the art that various changes may be made and equivalents may be substituted for elements thereof without departing from the scope of this invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A cantilever shelf assembly for attachment to the legs at one side or end of a table, comprising:

a pair of shelf support brackets each having a first surface, an opposed second surface and an elongated, U-shaped end forming opposed first and second clamp arms having an arcuate surface therebetween, each of said shelf support brackets being adapted to mount to a leg so that said arcuate surface rests against a first side of the leg and said first and second clamp arms straddle the leg;

a set screw insertable through a threaded bore formed in each of said opposed first and second clamp arms of both said shelf support brackets, said set screw being adapted to contact a second side of the leg opposite said first side thereof upon insertion through said threaded bores to mount said shelf support brackets to the leg;

a bolt insertable through a first bore formed in said first clamp arm and into an aligning, second bore formed in said second clamp arm of each said shelf support brackets, said first and second bores being formed in said clamp arms so that they are spaced outwardly from said second surface of the leg, said bolt being attached to said first and second clamp arms by a nut to maintain said first and second clamp arms in a fixed lateral position relative to one another;

a shelf;

means for mounting said shelf upon said first surface of each said shelf support brackets.

2. The cantilever shelf assembly of claim 1 in which said first and second clamp arms are each formed with a first end co-planar with said first surface of said shelf support brackets and a second end spaced from said first end, said threaded bores being formed nearer said first end of said clamp arms than said second end.

3. The cantilever shelf assembly of claim 1 in which the legs of the table or chair each have a longitudinal axis, an inner side, and an outer side which engages said arcuate surface of said first and second clamp arms, said threaded bores being formed in said first and second clamp arms such that when mounted to the legs said threaded bores are located at said inner side of the leg rearwardly of a vertical plane passing through said longitudinal axis of the leg perpendicular to said clamp arms.

4. The cantilever shelf assembly of claim 1 in which said first surface of each said shelf support brackets includes a pair of spaced extensions formed with an elongated slot, said means for mounting said shelf atop said shelf support brackets comprising bolts insertable through bores formed in said shelf and into said elongated slots of said extensions.

5. A cantilever shelf assembly for attachement to the legs at one side or end of a table or chair, comprising:

a pair of shelf support brackets each having an inner end, an outer end, a planar upper surface and a tapered lower surface spaced from said upper surface, said spaced between said upper and lower surfaces increasing from said outer end to said inner end;

said inner end of each shelf support bracket being formed in a U-shaped defining opposed first and second clamp arms having top and bottom portions and an arcuate surface therebetween, said shelf support brackets being adapted to mount to a table or chair leg so that said arcuate surface rests against a first side of the leg and said first and second clamp arms straddle the leg;

a set screw insertable through a threaded bore formed adjacent said top portion of each of said first and second clamp arms of both said shelf support brackets, said set screws being adapted to contact a second side of the leg opposite said first side thereof to mount said shelf support brackets thereto, said bottom portion of said first and second clamp arms being adapted to rest agianst the leg so that a downwardly directed load applied to said outer end of said support brackets pivot said bottom portion of said first and second clamp arms about said set screws and against the leg;

a bolt insertable through a first bore formed in said first clamp arm and into an aligning, second bore formed in said second clamp arm of each said shelf support brackets, said first and second bores being formed in said clamp arms so that they are spaced outwardly from said second surface of the leg, said bolt being attached to said first and second arms by a nut to maintain said first and second arms in a fixed lateral position relative to one another;

a shelf;

means for mounting said shelf upon said first surface of each said shelf support brackets.

6. A cantilever shelf assembly for attachment to the legs at one side or end of a table, comprising:

a pair of shelf support brackets each having a first surface, an opposed second surface and an elongated, U-shaped end forming opposed first and second clamp arms having an arcuate surface therebetween, said shelf support brackets being adapted to mount to a table or chair leg so that said arcuate surface rests against a first side of the leg and said first and second clamp arms straddle the leg;

a set screw insertable through a threaded bore formed in each of said opposed first and second clamp arms of both said shelf support brackets, said set screw being adapted to contact a second side of the leg opposite said first side thereof upon insertion through said threaded bores to mount said shelf support brackets to the leg;

a bolt insertable through a first bore formed in said first clamp arm and into an aligning, second bore formed in said second clamp are of each said shelf support brackets, said first and second bores being formed in said clamp arms so that they extend outwardly from said second surface of the leg, said bolt being attached to said first and second arms by a nut to maintain said first and second arms in a fixed lateral position relative to one another;

a shelf;

means for mounting said shelf upon said first surface of each said shelf support brackets;

a stabilizer leg assembly including a rod and a strap having opposed ends and a center portion fixedly mounted to said rod, each said opposed ends of said stabilizer leg assembly being adapted to mount to one of the legs so that said rod is positioned outwardly from and between the legs.

7. The cantilever shelf assembly of claim 6 in which said opposed ends of said strap of said stabilizer leg assembly are U-shaped to wrap around a portion of the leg, a bolt being connected to each said U-shaped ends to clamp them against a leg.

* * * * *